US006435174B1

(12) United States Patent
Spilde et al.

(10) Patent No.: US 6,435,174 B1
(45) Date of Patent: Aug. 20, 2002

(54) FLUID HEATER COIL CONFIGURATION AND FABRICATION METHOD

(75) Inventors: Gary Spilde; John W. Finger; Andrew Johnke, all of Beresford, SD (US)

(73) Assignee: Siout Steam Cleaner Corporation, Beresford, SD (US)

( * ) Notice: Subject to any disclaimer, the term of this patent is extended or adjusted under 35 U.S.C. 154(b) by 14 days.

(21) Appl. No.: 09/702,413

(22) Filed: Oct. 31, 2000

(51) Int. Cl.[7] ..... A47J 27/06; F24H 1/18

(52) U.S. Cl. ..... 126/378.1; 126/349; 122/18.2; 122/250 R

(58) Field of Search ..... 126/378.1, 377.1, 126/376.1, 373.1, 344, 349; 431/154; 122/18.2, 18.1, 243, 244, 247, 248, 249, 250 R

(56) References Cited

U.S. PATENT DOCUMENTS

| | | | | |
|---|---|---|---|---|
| 219,311 | A | 9/1879 | Salisbury | 122/244 |
| 430,856 | A | 6/1890 | Jennings | 122/252 |
| 826,546 | A | 7/1906 | Cushing | 122/249 |
| 978,491 | A | 12/1910 | Savage | 126/349 |
| 1,050,632 | A | 1/1913 | Erk | 122/249 |
| 2,291,023 | A | 7/1942 | Burklin | 122/18.4 |
| 2,708,436 | A | 5/1955 | Foster | 126/349 |
| 3,563,212 | A | 2/1971 | Hoagland | 122/250 R |
| 4,090,090 | A | 5/1978 | Riley et al. | 126/25 R |
| 4,180,050 | A | 12/1979 | Sizemore | 126/25 R |
| 4,352,454 | A | 10/1982 | Ewing | 126/101 |
| 4,428,363 | A | 1/1984 | Komula | 126/585 |
| 4,479,484 | A | 10/1984 | Davis | 122/18.2 |
| 4,480,631 | A | 11/1984 | Kristensen | 122/183 |
| 4,556,104 | A | 12/1985 | Engelhardt | 122/160 |
| D287,999 | S | 1/1987 | Stowell | |
| 4,644,906 | A | 2/1987 | Garabedian et al. | 122/32 |
| 5,152,253 | A | 10/1992 | Jenko et al. | 122/510 |
| 5,201,807 | A | 4/1993 | Lilijenberg et al. | 122/18.4 |
| 5,228,413 | A | 7/1993 | Tam | 122/250 R |
| 5,540,215 | A | 7/1996 | Fritzsche et al. | 126/374.1 |
| 5,659,657 | A | 8/1997 | Overdorf | |
| 5,816,199 | A | 10/1998 | Khizh et al. | 122/18.4 |

*Primary Examiner*—Henry Bennett
*Assistant Examiner*—Josiah C. Cooks

(57) ABSTRACT

A spiral fluid heater coil system for facilitating drainage of fluid from the heater and increasing the efficiency of transferring heat to a fluid. The spiral fluid heater coil system includes a heater assembly including a combustion chamber having a chamber perimeter wall defining a chamber interior. The chamber perimeter wall has an upper end and a lower end, with the upper end of the chamber perimeter wall defining an opening into the chamber interior. The heater assembly includes a burner apparatus for burning fuel and expelling heat into the chamber interior of the combustion chamber, with the burner apparatus being positioned adjacent the lower end of the chamber perimeter wall for directing heat upwardly in the chamber interior toward the upper end of the chamber perimeter wall. The heating assembly includes a heating conduit for moving fluid through the heater housing to heat the fluid. The heating conduit has a heating portion positioned adjacent to opening in the upper end of the chamber perimeter wall of the combustion chamber for permitting heat from the chamber interior to pass through the heating portion of the heating conduit. The heating portion includes at least one tier, and the tier comprises a spiral coil having a plurality of spirals lying substantially in a common plane. Preferably, the heating conduit includes one or more pairs of tiers, in which an upper tier is oriented above a lower tier, and an innermost spiral of the lower tier is connected to an innermost spiral of the upper tier such that fluid is moved from an outermost spiral of the lower tier to the innermost spiral of the lower tier to the innermost spiral of the upper tier to an outermost spiral of the upper tier.

17 Claims, 6 Drawing Sheets

FLUID HEATER COIL CONFIGURATION AND FABRICATION METHOD

BACKGROUND OF THE INVENTION

1. Field of the Invention

The present invention relates to fluid heater tubing coils and more particularly pertains to a new spiral fluid heater coil system for facilitating drainage of fluid from the heater and increasing the efficiency of transferring heat to a fluid.

2. Description of the Prior Art

Devices for pressurizing and heating fluid are known in the art. One type of fluid heating device uses combustion of a fuel in a combustion chamber to heat fluid moving through a helical coil of tubing located in the combustion chamber. Typically, a burner is located at one end of the combustion chamber, and one or more coils of the tubing are typically located in the chamber toward the other end of the chamber. The burner directs a flame toward the coils of tubing such that the hot combustion gases move around the tubing.

The coiled tubing for moving fluid through the fluid heating device periodically needs to be drained, such as, for example, prior to maintenance of the fluid heating device, or prior to exposure to freezing temperatures, or prior to extended periods of non-use of the device to minimize corrosion of the fluid heating device. However, the conventional and predominant fluid heater design positions several helical coils of tubing in an upper portion of the combustion chamber to increase heat transfer to the fluid. The multiple helical coils are typically positioned in a coaxial arrangement with inner helical coils positioned or nested inside outer helical coils to form a relatively dense package of coils. The coils are connected together in a series, so that the fluid flows in an upward direction in one helical coil, in a downward direction in another helical coil, upward in still another helical coil, and so forth. The up and down undulations in the fluid path make it extremely difficult, if not impossible, to completely drain the fluid from the series of helical coils when necessary.

A system of helical coils is also relatively inefficient for producing heat transfer, because there are vertical air gaps between the coils through which the hot gases can pass without contacting the coils and many portions of the coils receive very limited exposure to the heated gases because of the dense vertical packing of the coils. Thus, helical coil systems are relatively inefficient and therefore typically require relatively long lengths of tubing to achieve a desirable level of heat transfer.

Sporadic attempts have been made to utilize spiral coils of tubing in fluid heater devices. However, manufacturing difficulties in fabricating such spiral coils have prevented the common use of spiral coils in fluid heaters. A single coil of tubing in a fluid heater is generally insufficient to achieve a desirable level of heat transfer to the fluid from the heated gases of the combustion chamber. Thus, more than one spiral coil must be used, but manufacturing difficulties have made such an arrangement very difficult to manufacture and utilize more than one spiral coil in a practical manner. The conventional manner of forming the spiral coils is to form each of the spiral coils separately and then join the spiral coils together in a series. However, linking the tubing of each of the spiral coils is difficult, since a weld is necessary at the end of the tubing located at the center of each of the coils for linking to an adjacent coil, especially if more than two coils are used. Further, the density (e.g., radial proximity) of each spiral of the spiral coil and the axial proximity of adjoining spiral coils has been limited by conventional fabrication processes.

The spiral fluid heater coil system according to the present invention substantially departs from the conventional concepts and designs of the prior art, and in so doing provides an apparatus which facilitates drainage of fluid from the heater, provides a smaller, more compact, dense coil arrangement, and increases the efficiency of transferring heat to a fluid compared to conventional concentric helical coil configurations.

SUMMARY OF THE INVENTION

In view of the foregoing disadvantages inherent in the known types of fluid heater tubing coils now present in the prior art, the present invention provides a new spiral fluid heater coil system construction wherein the same can be utilized for facilitating drainage of fluid from the heater and increasing the efficiency of transferring heat to a fluid.

The general purpose of the present invention, which will be described subsequently in greater detail, is to provide a new spiral fluid heater coil system apparatus and method which has many of the advantages of the fluid heater tubing coils mentioned heretofore and many novel features that result in a new spiral fluid heater coil system which is not anticipated, rendered obvious, suggested, or even implied by any of the prior art fluid heater tubing coils, either alone or in any combination thereof.

To attain this, the present invention generally comprises a heater assembly including a combustion chamber having a chamber perimeter wall defining a chamber interior. The chamber perimeter wall has an upper end and a lower end, with the upper end of the chamber perimeter wall defining an opening into the chamber interior. The heater assembly includes a burner apparatus for burning fuel and expelling heat into the chamber interior of the combustion chamber, with the burner apparatus being positioned adjacent the lower end of the chamber perimeter wall for directing heat upwardly in the chamber interior toward the upper end of the chamber perimeter wall. The heating assembly includes a heating conduit for moving fluid through the heater housing to heat the fluid. The heating conduit has a heating portion positioned adjacent to an opening in the upper end of the chamber perimeter wall of the combustion chamber for permitting heat from the chamber interior to pass through the heating portion of the heating conduit. The heating portion includes at least one tier, and the tier comprises a spiral coil having a plurality of spirals lying substantially in a common plane. Preferably, the heating conduit includes an upper tier oriented above a lower tier, and an innermost spiral of the lower tier is connected to an innermost spiral of the upper tier such that fluid is moved from an outermost spiral of the lower tier to the innermost spiral of the lower tier to the innermost spiral of the upper tier to an outermost spiral of the upper tier, for each pair of spiraled heating sections.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Various objects of the invention, along with the various features of novelty which characterize the invention, are described below in the detailed description and pointed out with particularity in the claims annexed to and forming a part of this disclosure.

For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
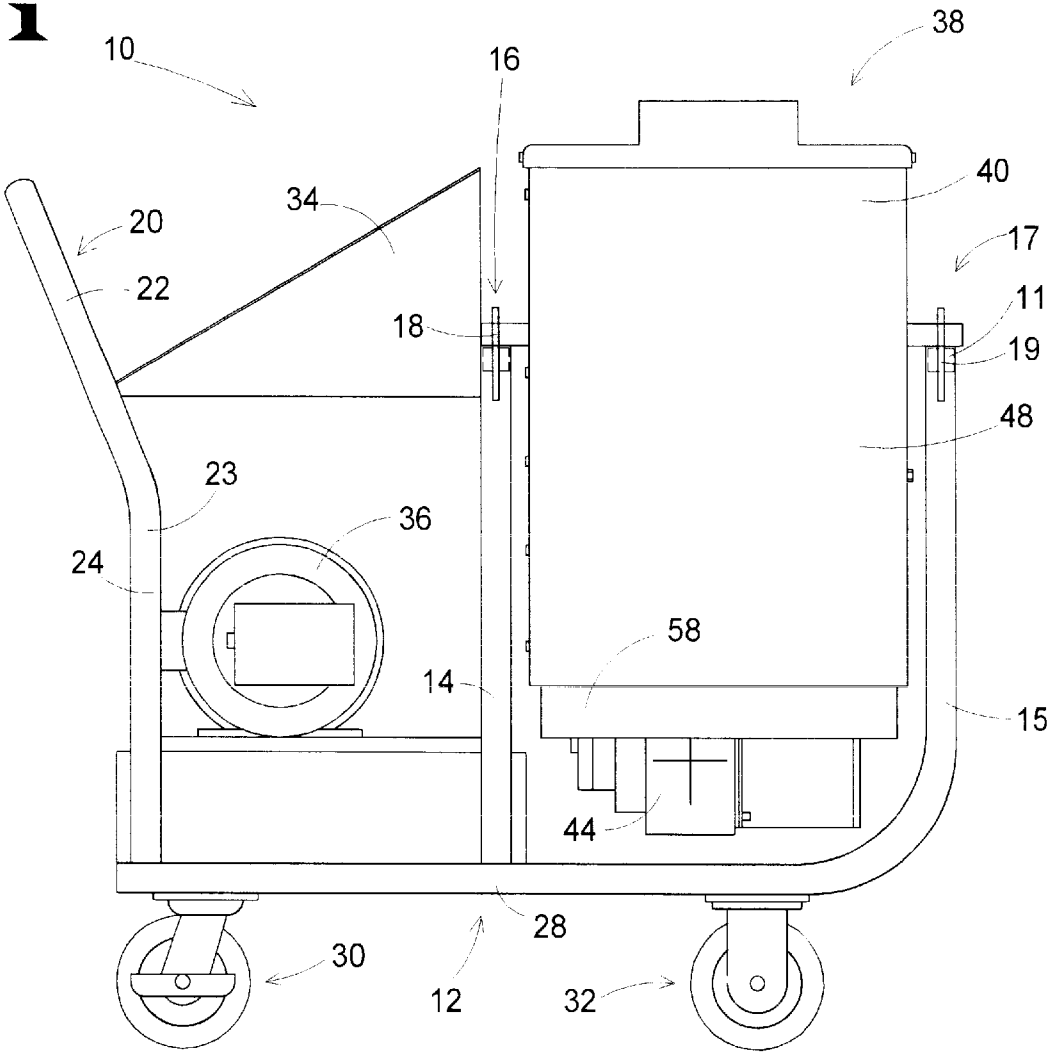
FIG. 1 is a schematic side view of a new fluid heater system with the improved heater assembly according to the present invention.
Figure 2:
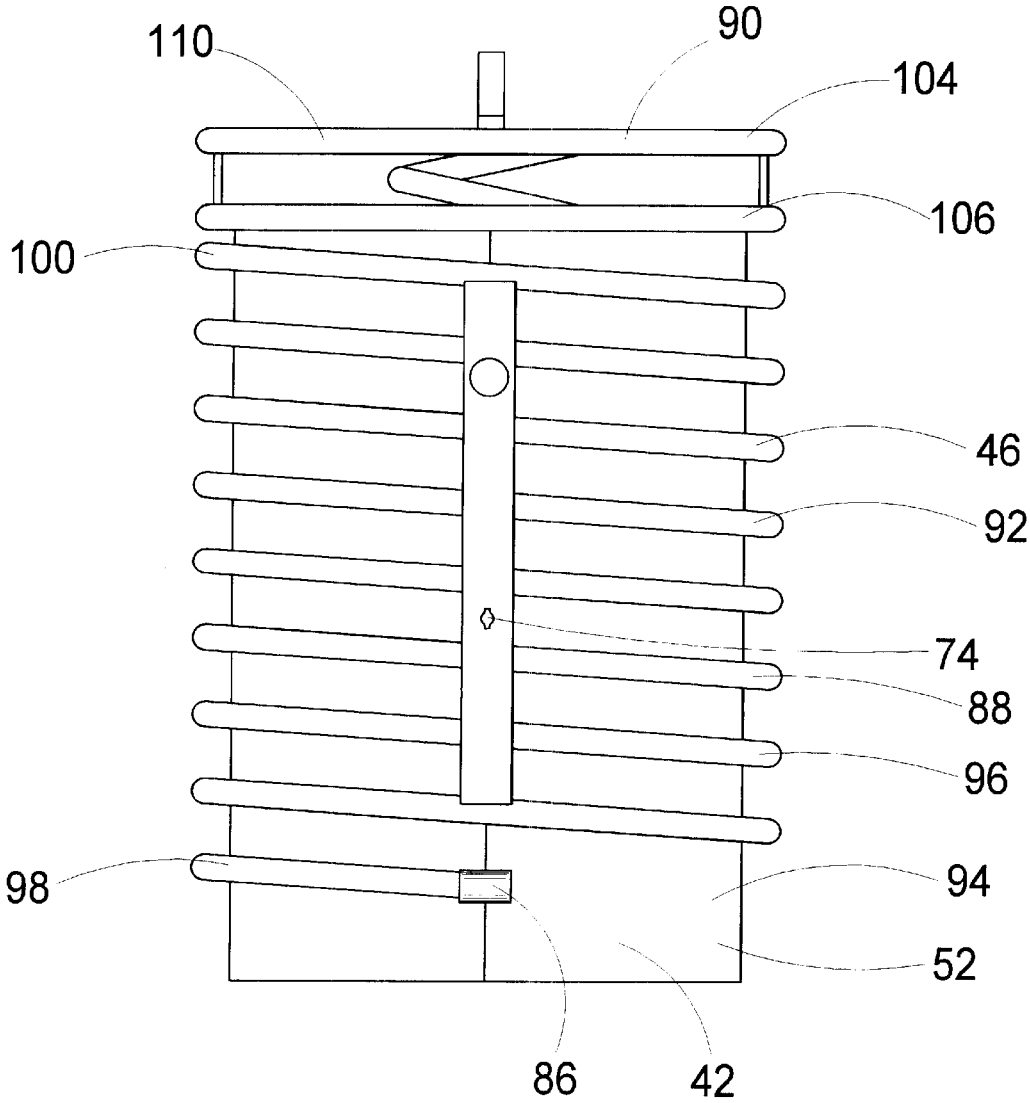
FIG. 2 is a schematic end view of the combustion chamber and heating conduit of the present invention.
Figure 3:
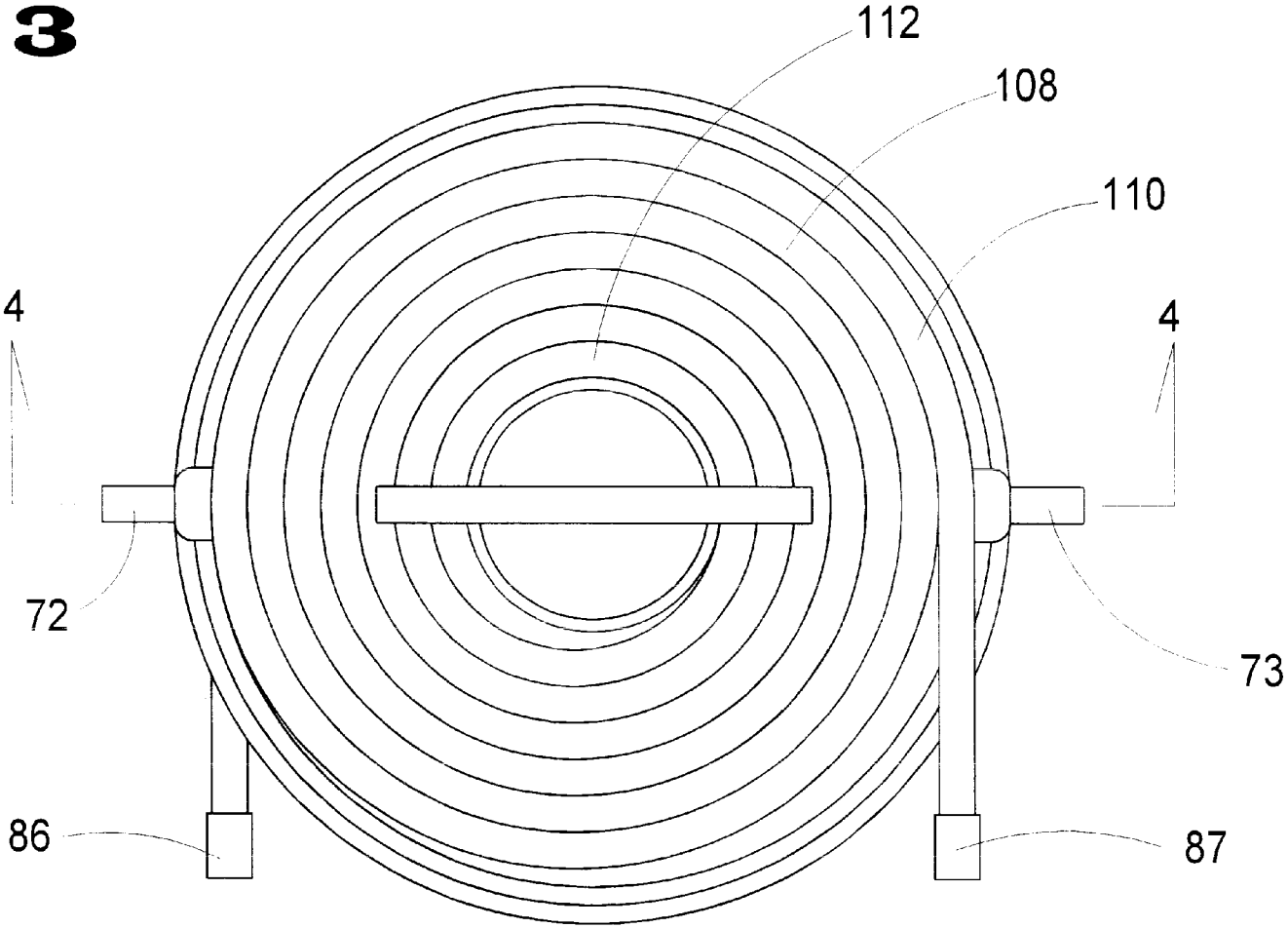
FIG. 3 is a schematic top view of the heating portion of the heating conduit.
Figure 4:
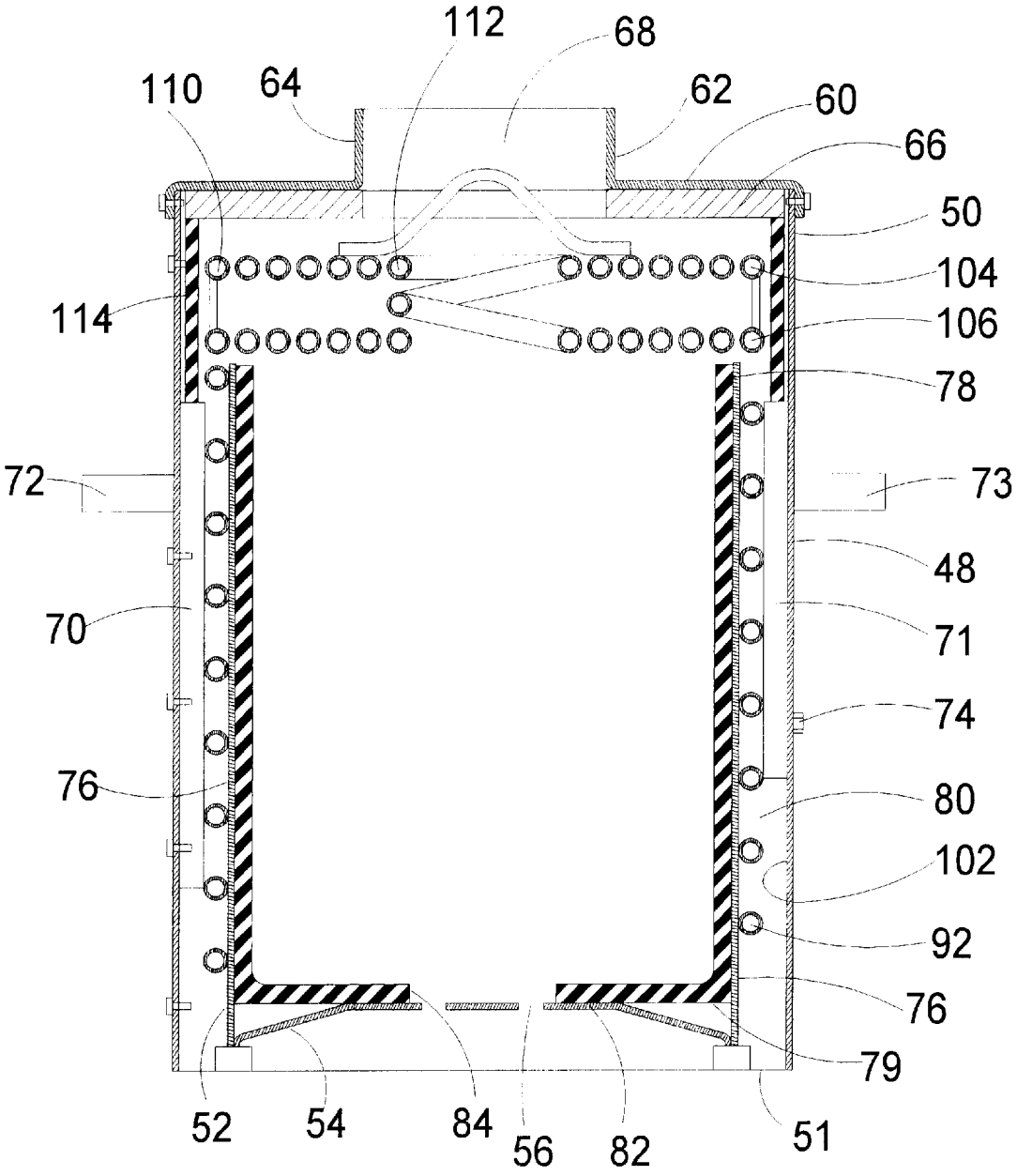
FIG. 4 is a schematic sectional view of the heater assembly taken along line 4—4 of FIG. 3.
Figure 5:
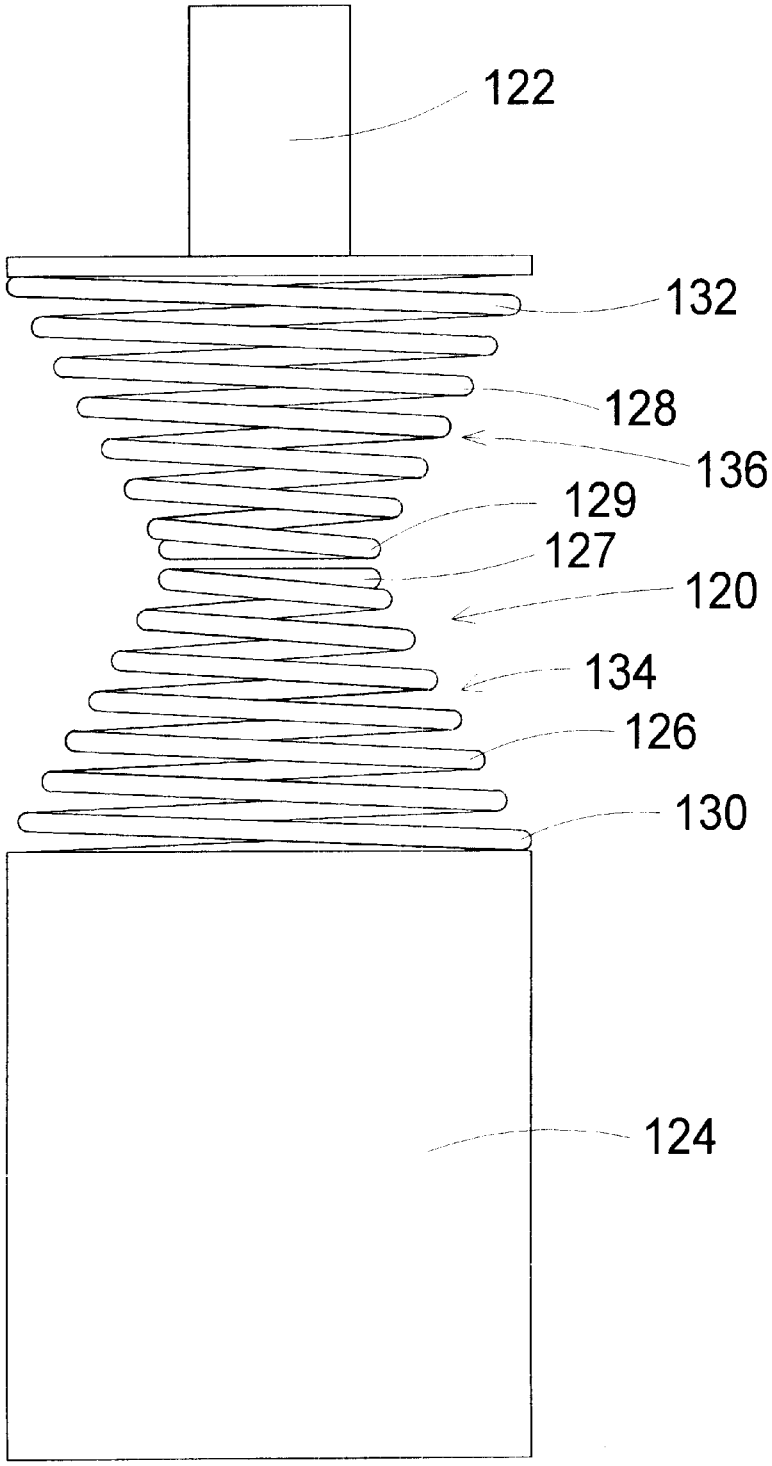
FIG. 5 is a schematic side view of the mandrel of the present invention shown in the assembled condition.
Figure 6:
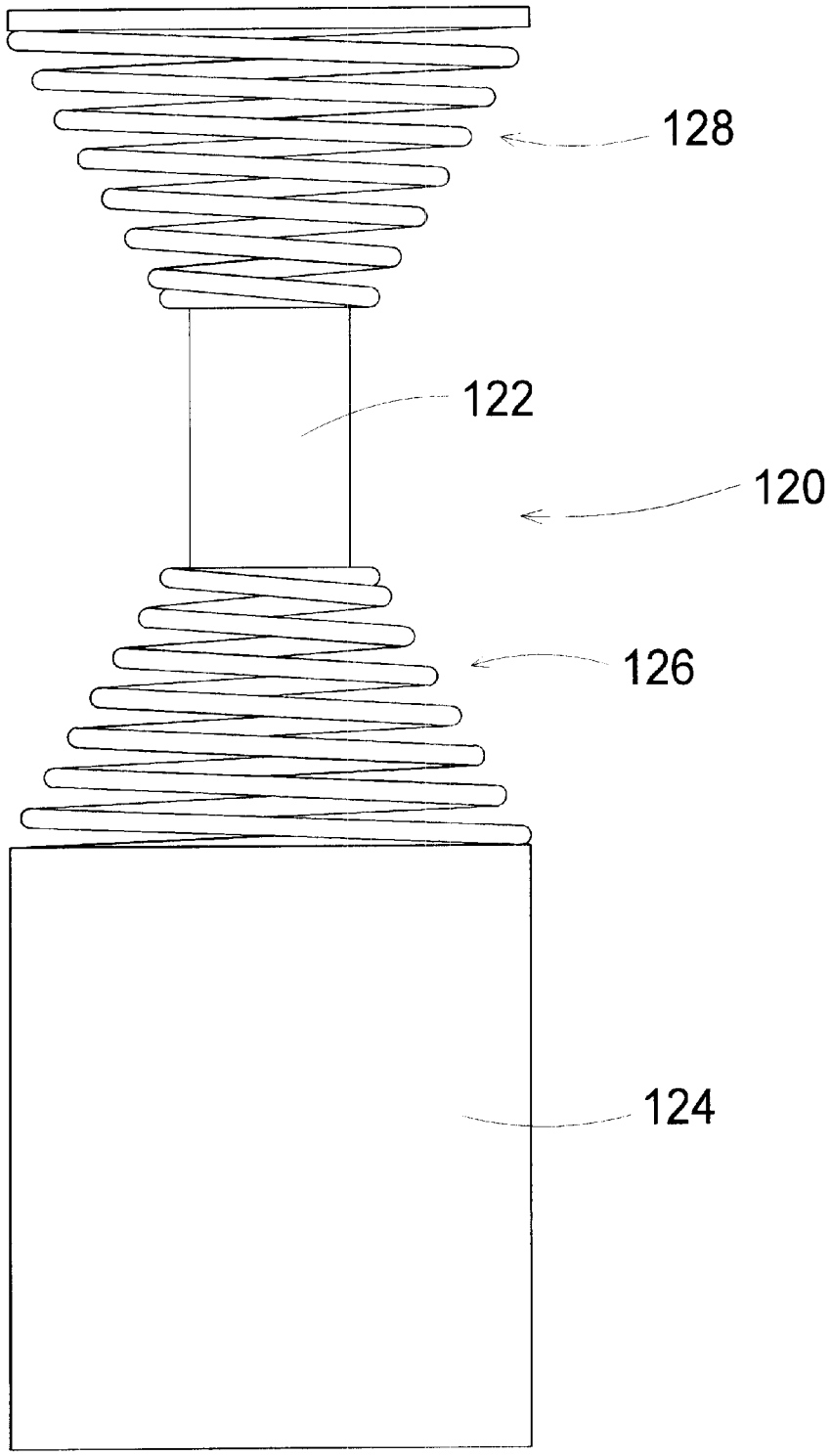
FIG. 6 is a schematic side view of the mandrel of the present invention shown in the separated condition.

With reference now to the drawings, and in particular to FIGS. 1 through 6 thereof, a new spiral fluid heater coil system embodying the principles and concepts of the present invention and generally designated by the reference numeral 10 will be described.

As best illustrated in FIGS. 1 through 4, the fluid heating apparatus of the invention generally comprises a support frame 12, and a heater assembly 38 including a heater housing 40, a combustion chamber 42, a burner apparatus 44, and a heating conduit 46 for capturing (in a flow of fluid) heat from the combustion chamber.

One preferred embodiment of the support frame 12 of the invention includes a pair of upstanding heater support members 14, 15 that are generally spaced from each other. Each of the heater support members 14, 15 may comprise a pair of substantially vertically oriented support posts and a cross member 11 extending between the support posts. Optionally, one of the heater support members may have a second cross member (not shown).

The support frame 12 may include an upstanding handle member 20. The upstanding handle member preferably includes an upper portion 22 and a lower portion 23. The upper portion 22 may lie in a plane angled from a plane in which the lower portion 23 lies in order to extend the upper portion away from the bulk of the support frame for facilitating gripping by a user walking behind the frame when the frame is being pushed. The angle between the planes of the upper 22 and lower 23 portions is preferably an obtuse angle, with the obtuse angle illustratively measuring approximately 160 degrees. Ideally, the lower portion 23 is substantially vertically oriented and is oriented substantially parallel to the first 14 and second 15 heater support members. The handle member may comprise a pair of upstanding handle posts 24 and a handle cross member (not shown) extending between the handle posts.

The support frame 12 may also include a base member 28. The heater support members 14, 15 and the handle member 20 have lower portions that are mounted on the base member 28, and the support 14, 15 and handle 20 members extend upwardly from the base member.

The support frame 12 may also include a plurality of wheels for permitting rolling transport of the support frame across a surface. The plurality of wheels is mounted on the base member 28. Preferably, a first pair 30 of the plurality of wheels is mounted on the base member in a manner permitting rotation of the wheels in a single plane, and illustratively the first pair 30 is mounted adjacent one of the support members 14, 15. Preferably, a second pair 32 of the plurality of wheels is mounted on the base member in a manner permitting rotation of the wheels in a plurality of planes, such as, for example, a swivel caster structure. The second pair 32 of wheels may be mounted on the base member adjacent the handle member 20. Optionally, at least one of the second pair 32 of wheels has a locking means for selectively locking each wheel against rotation, and the locking means may be actuated by a rocker lever mounted on the axle of the wheel.

A control panel 34 may be provided on the support frame 12 for supporting controls for the fluid heater apparatus. Illustratively, the control panel 34 may be mounted on the handle member 20 and the first heater support member 14.

A pump 36 may optionally be provided for moving the fluid to be heated through the fluid heater apparatus, and the pump is mounted on the support frame 12.

The heater assembly 38 of the invention is provided for heating fluid, such as water, that is moved through the heater assembly by means such as, for example, the pump 36. The heater assembly 38 is mounted on the support frame 12 in a manner supporting the heater assembly above a ground surface, and preferably above the base member of the frame 12.

The heater assembly generally comprises the heater housing 40, the combustion chamber 42 located in the heater housing, the burner apparatus 44 mounted on the heater housing, and the heating conduit 46 for moving fluid through the heater housing.

The heater housing 40 includes an outer peripheral wall 48. The outer peripheral wall defines an interior of the heater housing, and the outer peripheral wall has an upper opening 50 and a lower opening 51 into the interior. The preferred outer peripheral wall has a substantially cylindrical shape, with the upper 50 and lower 51 openings being substantially circular.

The heater housing 40 may also include an inner peripheral wall 52. The inner peripheral wall 52 is positioned in the interior defined by the outer peripheral wall 48. The inner peripheral wall may have a substantially cylindrical shape, and preferably, the cylindrical inner peripheral wall is oriented coaxially with the cylindrical outer peripheral wall.

The heater housing 40 may also include a bottom wall 54 that extends across the lower opening of the outer peripheral wall. The bottom wall may have a central burner opening 56 for accommodating the burner assembly. In one embodiment of the invention, the bottom wall has a shallow frustaconical shape that has a generally concave outward surface.

The heater housing 40 may also include a skirt 58 that extends from the outer peripheral wall at the lower opening for at least partially protecting the burner assembly from, for example, spray from a pressurized spray gun. Preferably, the skirt has a substantially cylindrical shape and extends from the outer peripheral wall in a downward direction from the lower opening. The skirt may comprise a resiliently flexible material that facilitates periodic manual movement of the skirt for access to the burner assembly mounted on the bottom wall area of the heater housing.

The heater housing 40 may also include a top wall 60 covering the upper opening 50 of the outer peripheral wall. The top wall may be removably mounted on the outer peripheral wall adjacent to the upper opening. The top wall may have a circular shape for mounting on a cylindrically-shaped outer peripheral wall. Preferably, the top wall has a central vent opening 62 for permitting exhaust of combustion gases from the combustion chamber. The top wall thus has an annular shape. In one illustrative embodiment of the invention, the top wall has a diameter more than twice a diameter of the central vent opening. A retaining lip 64 may depend from an outer edge of the top wall, and may be removably secured to the outer peripheral wall. Optionally, an insulative material 66 may be positioned adjacent to an inward surface of the top wall for reducing the temperature of the top wall of the heater housing.

A vent wall 68 may be provided surrounding the central vent opening in the top wall. The vent wall extends generally upwardly in a substantially perpendicular orientation to the top wall.

Optionally, the fluid heater system may be adapted to permit pivoting of the heater assembly with respect to the support frame. Each of the upstanding heater support members 14, 15 of the support frame may have a pivot mount 16, 17 formed thereon. One of the pivot mounts is preferably formed on the cross member 11 of each of the heater support members. Illustratively, each of the pivot mounts 16, 17 may comprise a U-shaped bolt 18, 19 having arms extending through the cross member 11. Optionally, the structure of the pivot mount may take other forms, such as, for example, a hole or channel formed in the cross member. Preferably, the pivot mount 16 of a first one 14 of the heater support members is axially aligned with the pivot mount 17 of a second one 15 of the heater support members. A pair of mounting members 70, 71 may be provided for supporting the heater housing on the heater support members 14, 15 of the support frame 12. Each of the mounting members may be located adjacent an inner surface of the outer peripheral wall 48. The mounting members 70, 71 are located adjacent to substantially diametrically opposite locations of the outer peripheral wall. In one embodiment of the invention having the inner peripheral wall 52, the mounting members are positioned between the outer and inner peripheral walls.

A pair of pivot shafts 72, 73 may be provided for mounting the heater housing to the support frame. Each of the pivot shafts extend outwardly from the outer peripheral wall, and each of the pivot shafts are rotatably received in one of the pivot mounts 16, 17 of the heater support members of the support frame. A first one 72 of the pivot shafts is axially aligned with and is substantially coaxial with a second one 73 of the pivot shafts. The first one 72 of the pivot shafts extends in a diametrically opposite direction from the heater housing with respect to the second one 73 of the pivot shafts. Each of the pivot shafts is pivotally mounted on one of the mounting members. In the embodiment of the invention having pivot mounts employing U-shaped bolts 18, 19, the U-shaped bolt 19 clamps a portion of one 17 of the pivot shafts against the cross member 11. Preferably, one 71 of the mounting members has a first locking aperture 74 formed in the mounting member at a location that is separated from the location of the pivot shaft mounted on the mounting member.

The pivotal mounting of the heater assembly 38 on the support frame 12 permits selective pivoting of the heater assembly with respect to the support frame. An operational position of the heater assembly is characterized by a central axis of the combustion chamber being oriented in a substantially vertical direction. A maintenance position of the heater assembly is characterized by the central axis being shifted or rotated from the substantially vertical direction toward a generally horizontal direction. Thus, pivoting of the heater assembly from the operational position to the maintenance position raises the burner assembly 44 relative to the combustion chamber for facilitating maintenance on the burner assembly.

The combustion chamber 42 of the heater assembly includes a chamber perimeter wall 76 that defines a chamber interior. The chamber perimeter wall has an upper end 78 and a lower end 79, and the upper end of the chamber perimeter wall is preferably substantially open into the chamber interior. The chamber perimeter wall of the combustion chamber may be substantially cylindrical, and is preferably substantially coaxial with the outer peripheral wall of the heater housing such that a perimeter chamber 80 is formed between the chamber perimeter wall of the combustion chamber and the outer peripheral wall of the heater housing. In embodiments of the invention employing an inner peripheral wall 52, the chamber perimeter wall has an outer surface oriented adjacent to an inner surface of the inner peripheral wall. Preferably, the chamber perimeter wall 76 comprises a material that reflects the heat from combustion back into the interior of the combustion chamber. Ideally, the material of the chamber perimeter wall comprises a refractive material for reflecting much of the combustion heat, and retaining a significant portion of the heat that is not reflected.

A heat reflective chamber floor wall 82 may be provided that extends across the chamber interior adjacent to the lower end of the chamber perimeter wall. The chamber floor wall may have a central opening 84 therein for receiving a portion of the burner assembly. The chamber floor wall preferably comprises a heat reflective material similar to the material forming the chamber perimeter wall, such as a refractive material.

The burner apparatus 44 is provided for burning fuel in the interior of the combustion chamber. The burner apparatus expels heat into the chamber interior of the combustion chamber. The burner apparatus is mounted on the bottom wall 54 of the heater housing and directs heat upwardly into the chamber interior of the combustion chamber toward the upper end of the perimeter wall. The burner apparatus may extend through the central opening 84 in the chamber floor wall 82 of the combustion chamber, with a serviceable portion of the burner apparatus being located below the floor wall.

The heating conduit 46 for moving fluid through the heater housing has an inlet 86 and an outlet 87. Preferably, the inlet 86 is fluidly connected to the pump 36 and the outlet 87 is fluidly connected to, for example, a dispensing hose (not shown) and a spray gun (not shown).

The heating conduit 46 includes a heating portion 90 that is located adjacent in the fluid flow to the outlet of the heating conduit. In a highly preferred but optional embodiment of the invention, the heating conduit 46 may also include a preheating portion 88 that is located adjacent in the fluid flow to the inlet of the heating conduit.

The optional preheating portion 88 of the heating conduit extends about the chamber perimeter wall 76 in the perimeter chamber 80 for absorbing heat passing through the chamber perimeter wall. The movement of unheated, relatively cool fluid (from, for example, the pump) through the perimeter chamber 80 of the heater housing permits the fluid to be initially heated prior to entry of the heating conduit into the combustion chamber. More importantly, the preheating portion serves to absorb heat passing through the chamber perimeter wall 76 from the combustion chamber which would otherwise pass through the perimeter chamber and heat the outer peripheral wall of the housing and create a burning injury hazard to exposed skin touching the outer surface of the outer peripheral wall. The preheating portion 88 of the heating conduit preferably comprises a substantially helical coil 92 extending around the chamber perimeter wall. If an inner peripheral wall is included in the heater housing, the preheating portion of the heating conduit may contact an outer surface 94 of the inner peripheral wall for maximizing the heat transfer from the chamber perimeter wall and the inner peripheral wall to the preheating portion of the heating conduit.

The helical coil 92 comprises a plurality of loops 96, and preferably, all of the loops have substantially equal diameter. The helical coil generally extends from a location adjacent to the lower end 79 of the chamber perimeter wall to a location adjacent to the upper end 78 of the chamber perimeter wall. Preferably, each of the loops 96 may be spaced from an adjacent one of the loops, and optionally the spacing between centers of adjacent loops is substantially uniform. Optionally, the spacing between adjacent loops may be reduced (or even eliminated) toward the upper region of the heater housing, especially at a vertical level above the upper end of the chamber perimeter wall.

Illustratively, the substantially uniform spacing between adjacent loops may be approximately two inches. In one embodiment of the invention, the helical coil 92 of the preheating portion of the heating conduit includes approximately eight loops. Preferably, each of the mounting members 70, 71 is mounted on at least two of the loops of the helical coil of the preheating portion for supporting the heating assembly.

The helical coil 92 has a lowermost loop 98 and an uppermost loop 100. The preheating portion is adapted such that fluid enters the lowermost loop 98 of the helical coil and exits the uppermost coil 100 of the helical coil. Optionally, the helical coil 92 is spaced from an inner surface 102 of the outer peripheral wall of the heater housing to produce an air space between the helical coil and the outer peripheral wall for reducing any heat transfer between the preheating portion 88 and the outer peripheral wall 48. Illustratively, the space between an outermost surface of the helical coil and the inner surface of the outer peripheral wall may be approximately one inch.

The heating portion 90 of the heating conduit is positioned adjacent to the upper end 78 of the chamber perimeter wall of the combustion chamber in a location permitting heated gases rising in the chamber interior to pass over the heating portion of the heating conduit before being vented from the interior of the heater housing. In a highly preferred embodiment of the invention, the heating portion is not located directly in the chamber interior of the combustion chamber, but is located at a vertical level above the upper end of the chamber perimeter wall.

In the preferred heater assembly, the preheating portion 88 is located at a vertical level below the heating portion 90. In one illustrative embodiment, a length of the preheating portion of the heating conduit is substantially equal to a length of the heating portion of the heating conduit, although the length of the heating portion is preferably at least as long, and may be relatively longer, than the preheating portion.

Significantly, the heating portion 90 comprises at least one tier, and most preferably includes at least two tiers. In the preferred multiple tier arrangement, an upper tier 104 is oriented above a lower tier 106, forming a pair of tiers. Each tier 104, 106 comprises a spiral coil, and each of the spiral coils comprises a plurality of spirals 108. The spirals 108 of each tier lie substantially in a common or single plane. The plane of each tier is preferably substantially horizontally oriented. The upper and lower tiers are preferably oriented substantially parallel to each other. Preferably, the upper and lower tiers are spaced from each other a distance that is approximately less than the diameter of the tubing forming the spirals to thereby minimize the vertical height occupied by the tiers in the heater housing. Preferably, the distance between adjacent spirals of the upper and lower tiers is less than approximately one pipe diameter for the most compact arrangement.

Each tier of the heating portion has an outermost spiral 110 and an innermost spiral 112, with a number of spirals nested therebetween. Illustratively, each of the tiers 104, 106 includes approximately seven spirals. The tiers are preferably adapted such that fluid is moved from the outermost spiral of the lower tier to the innermost spiral of the lower tier, and then to the innermost spiral of the upper tier to the outermost spiral of the upper tier. This arrangement beneficially permits a more vertically compact heating portion, as extra lengths of tubing (situated above or below the tiers) would otherwise be required to extend radially inward or outward from the center of the spirals for inlet or outlet of fluid. Significantly, the innermost spiral of the lower tier is fluidly connected to the innermost spiral of the upper tier, and as such permits fluid to exit the heating portion at the outermost spiral of the upper tier, and permits the tubing from the outermost spiral to directly exit the heater housing.

In one embodiment of the invention, the outermost spiral 110 of the spiral coil of the heating portion is fluidly connected to the uppermost loop 100 of the helical coil of the preheating portion 88 for receiving fluid therefrom. The outermost loop of the lower tier of the heating portion preferably has a diameter approximately equal to the loops of the preheating portion. Ideally, an outermost portion of the heating portion extends above the chamber perimeter wall and over the helical coil of the preheating portion.

Optionally, an insulative annular wall 114 may be positioned laterally outward from the outermost spirals of the heating portion 90 of the heating conduit for holding heat in the area above the combustion chamber. The insulative annular wall 114 is positioned inside of the outer peripheral wall 48 of the heater housing.

A preferred manner of forming the spiral coils of each of the tiers of the heating portion, especially utilizing one or more pairs of tiers and without requiring welding of the spirals of the tiers together, will now be set forth. As noted above, connection of multiple tiers or spirals together at the innermost spirals is highly desirable for accomplishing the most vertically compact package of coils in the heater housing. However, the conventional technique of joining tubing, by welding ends of the tubing together, is not suitable or even practical for connecting the innermost spirals of two adjacent spirals, especially if it is desirable to position the tiers relatively close together for minimizing vertical height. (Conventional welding techniques may be used to join one pair of tiers to another pair, since this welded joint is accessible at the outside of the spirals.) A solution that avoids this welding difficulty is to form the parallel, adjacent spirals from a single, continuous length of tubing.

A highly preferred technique for forming at least two spirals from a single, continuous length of tubing employs a mandrel 120 about which the continuous length of tubing may be wrapped to obtain the spiral shape. The mandrel 120 includes a central mounting shaft 122 for mounting to a forming machine which rotates the mandrel to draw the continuous length of tubing about the mandrel. The continuous length of tubing may be payed out from a supply of tubing, such as a straight length of tubing.

The mandrel 120 preferably, but not necessarily, includes a drum portion 124 positioned at one end of the mandrel. The drum portion has a substantially cylindrical shape with a substantially uniform diameter along its axial length. The drum portion may be employed to form the helical coil of the preheating portion of the heating conduit 46. Significantly, the helical coil may be formed as part of the same continuous length of the tubing as the spiral coils of the heating portion by wrapping the tubing about the drum portion of the mandrel. However, it should be noted that the helical coil may be formed from an initially separate length of tubing, since a weld connection of the helical coil to an outermost spiral of one of the spiral coils is not as difficult as welding to the innermost spiral of a spiral coil.

Significantly, the mandrel 120 includes a pair of axially opposed frustaconical portions 126, 128 joined together such that the smallest diameter sections 127, 129 of the frustaconical portions 126, 128 are positioned adjacent to each other. A largest diameter section 130 of a first one 126 of the frustaconical portions is positioned adjacent to the drum portion of the mandrel, if the drum portion is included on the mandrel. A largest diameter section 132 of a second one 128 of the frustaconical portions is positioned at an opposite end of the mandrel. Each of the frustaconical portions 126, 128 has a guide groove 134, 136 formed thereon for receiving and retaining the tubing as the length of tubing is wrapped about the portions 126, 128. The guide groove 134 spirals inward from the largest diameter section 130 of the first frustaconical portion 126 to the smallest diameter section 127 of the first frustaconical portion. The guide groove 136 spirals outward from the smallest diameter section 129 of the first frustaconical portion to the largest diameter section 132 of the second frustaconical portion 128.

In a preferred embodiment of the invention, the frustaconical portions 126, 128 of the mandrel 120 comprise a conical spiral of cylindrical rod (or optionally, tubing) extending in circles of decreasing diameter from the largest diameter section to the smallest diameter section of the frustaconical portion. The adjacent spirals of the conical spiral are axially spaced from each other such that a gap is formed therebetween, and the gap forms the guide groove for receiving the tubing to be formed on the mandrel. The gap should not be large enough that the length of tubing to be formed is able to pass inwardly through the gap. Optionally, the frustaconical portions could be constructed with a solid, continuous surface with the guide groove formed in the surface, although the preferred embodiment is considerably easier to fabricate and much lighter in weight than a mandrel with portions 126, 128 having a continuous surface.

Another preferred feature of the mandrel is the ability to selectively separate the first frustaconical portion 126 from the second frustaconical portion 128. Preferably, the second frustaconical portion 128 is removable from the first frustaconical portion 126 for permitting easy removal of the tubing from the mandrel after forming of the tubing on the portions. After removal of the second frustaconical portion from the mandrel, the formed tubing may be moved in an axial direction off of the first frustaconical portion (and the drum portion, if utilized).

Once the formed length of tubing has been removed from the mandrel, the conical helixes of the formed tubing are then forcibly pressed inward in an axial direction to bring each conical helix into a substantially planar configuration to form each of the spiral coils of the upper and lower tiers.

In this manner, a pair of spiral coils may be quickly and easily formed from a single continuous length of tubing without requiring welding of any portions of the spirals together. If required, pairs of spirals formed in the above-described manner may be welded together using conventional welding techniques.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A fluid heating apparatus comprising: a heater assembly including:

a combustion chamber comprising a chamber perimeter wall defining a chamber interior, the chamber perimeter wall having an upper end and a lower end, the chamber interior being bounded by the chamber perimeter wall and the upper and lower ends of the chamber perimeter wall, the upper end of the chamber perimeter wall defining an upper opening into the chamber interior;

a burner apparatus for burning fuel and heating the chamber interior of the combustion chamber, the burner apparatus being positioned adjacent the lower end of the chamber perimeter wall for directing combustion gases upwardly in the chamber interior toward the upper end of the chamber perimeter wall; and a heating conduit for moving fluid through the heater housing to heat the fluid, the heating conduit having an inlet and an outlet, the heating conduit including a preheating portion and a heating portion, the heating portion being positioned adjacent to the upper opening in the upper end of the chamber perimeter wall of the combustion chamber for permitting heat from the chamber interior to pass through the heating portion of the heating conduit, the heating portion comprising at least one tier, the tier comprising a spiral coil including a plurality of spirals lying substantially in a common plane;

wherein the preheating portion comprises a helical coil positioned about the chamber perimeter wall such that the chamber perimeter wall is positioned between the chamber interior and the preheating portion of the heating conduit such that the heating conduit does not extend into the chamber interior of the combustion chamber, the preheating portion of the heating conduit abutting an outer surface of the chamber perimeter wall for absorbing heat from the chamber perimeter wall of the combustion chamber; and wherein the beating portion of the heating conduit is positioned above the upper end of the perimeter chamber wall and above the chamber interior of the combustion chamber such that the heating conduit does not extend into the chamber interior of the combustion chamber.

2. The apparatus of claim 1 wherein the plane of the tier is substantially horizontally oriented.

3. The apparatus of claim 1 wherein the heating portion of the heating conduit includes an upper tier oriented above a lower tier.

4. The apparatus of claim 3 wherein each tier of the heating portion has an outermost spiral and an innermost spiral with spirals nested therebetween.

5. The apparatus of claim 4 wherein the innermost spiral of the lower tier is connected to the innermost spiral of the upper tier.

6. The apparatus of claim 3 wherein the upper and lower tiers are oriented substantially parallel to each other.

7. The apparatus of claim 3 wherein a distance between the spiral coils of the upper and lower tiers is approximately less than a diameter of the heating conduit.

8. The apparatus of claim 5 wherein the tiers are adapted such that fluid is moved from the outermost spiral of the lower tier to the innermost spiral of the lower tier to the innermost spiral of the upper tier to the outermost spiral of the upper tier.

9. The apparatus of claim 1 wherein the perimeter wall is substantially continuous between the upper and lower ends.

10. The apparatus of claim 1 wherein the preheating portion is positioned with respect to the heating portion such that fluid passes through the preheating portion prior to passing through the heating portion, and wherein the preheating portion is located below the heating portion.

11. The apparatus of claim 1 wherein the opening defined by the upper end of the chamber perimeter wall lies in a plane, the spiral coil of the tier being located closely adjacent to the plane of the opening such that heat moving out of the chamber interior is forced to move through the spiral coil.

12. The apparatus of claim 1 wherein the helical coil comprises a plurality of loops each having substantially equal diameters.

13. The apparatus of claim 12 wherein the helical coil has a lowermost loop and an uppermost loop, the preheating portion being adapted such that fluid enters the lowermost loop of the helical coil and exits the uppermost coil of the helical coil, an outermost spiral of the spiral coil of the heating portion being connected to the uppermost loop of the helical coil of the preheating portion.

14. The apparatus of claim 1 wherein the heater assembly comprises a heater housing, the heater housing comprising:

an outer peripheral wall, the outer peripheral wall having a substantially cylindrical shape, the outer peripheral wall having an upper opening and a lower opening; and an inner peripheral wall, the inner peripheral wall being oriented in an interior defined by the outer peripheral wall, the inner peripheral wall having a substantially cylindrical shape, the inner peripheral wall being oriented coaxially with the outer peripheral wall.

15. The apparatus of claim 1 additionally comprising a support frame on which the heater assembly is mounted, the support frame comprising a pair of spaced upstanding heater support members, each of the upstanding heater support members having a pivot mount formed therein, the heater assembly being pivotally mounted on the heater support members to permit pivoting of the heater assembly with respect to the support frame.

16. The apparatus of claim 1 wherein the tier of the heating portion has an outermost spiral, the outermost spiral having a diameter that is substantially equal to a diameter of the opening of the upper end of the chamber perimeter wall.

17. A fluid heating apparatus comprising:

a support frame including a pair of spaced upstanding heater support members, each of the upstanding heater support members having a pivot mount formed therein;

a heater assembly mounted on the support frame, the heater assembly being pivotally mounted on the support frame for permitting selective pivoting of the heater assembly with respect to the support frame, the heater assembly comprising:

a heater housing, the heater housing comprising:

an outer peripheral wall, the outer peripheral wall having a substantially cylindrical shape, the outer peripheral wall having an upper opening and a lower opening; and an inner peripheral wall, the inner peripheral wall being oriented in an interior defined by the outer peripheral wall, the inner peripheral wall having a substantially cylindrical shape, the inner peripheral wall being oriented coaxially with the outer peripheral wall;

a combustion chamber located in the heater housing, the combustion chamber comprising a heat reflective chamber perimeter wall defining a chamber interior, the chamber perimeter wall having an upper end and a lower end, the chamber interior being bounded by the chamber perimeter wall and the upper and lower ends of the chamber perimeter wall, the upper end of the chamber perimeter wall being substantially open into the chamber interior;

a burner apparatus for burning fuel, the burner apparatus expelling heat into the chamber interior of the combustion chamber, the burner apparatus being adapted to direct heat upwardly into the chamber interior of the combustion chamber toward the upper end of the chamber perimeter wall;

a heating conduit for moving fluid through the heater housing to heat the fluid, the heating conduit having an inlet and an outlet, the heating conduit having a preheating portion fluidly adjacent to the inlet and a heating portion fluidly adjacent to the outlet, the preheating portion being located below the heating portion, wherein a length of the preheating portion of the heating conduit is substantially equal to a length of the heating portion of the heating conduit;

the preheating portion of the heating conduit extending about the chamber perimeter wall of the combustion chamber in the perimeter chamber for absorbing heat from the chamber perimeter wall of the combustion chamber, the preheating portion of the heating conduit comprising a substantially helical coil extending around the chamber perimeter wall such that the chamber perimeter wall is positioned between the chamber interior and the preheating portion such that the heating conduit does not extend into the chamber interior of the combustion chamber, the helical coil comprising a plurality of loops each having substantially equal diameters, the helical coil extending from a location adjacent to the lower end of the chamber perimeter wall to a location adjacent the upper end of the chamber perimeter wall, each of the loops being spaced from an adjacent one of the loops, the preheating portion of the heating conduit being in contact with an outer surface of the inner peripheral wall of the heater housing, the helical coil having a lowermost loop and an uppermost loop, the preheating portion being adapted such that fluid enters the lowermost loop of the helical coil and exits the uppermost coil of the helical coil, wherein the helical coil is spaced from an inner surface of the outer peripheral wall of the heater housing to produce an air space between the helical coil and the outer peripheral wall;

the heating portion of the heating conduit being positioned adjacent to the upper end of the chamber perimeter wall of the combustion chamber for permitting heat from the chamber interior to pass over the heating portion of the heating conduit, the heating portion being positioned above the upper end of the perimeter chamber wall and above the chamber interior of the combustion chamber such that the heating conduit does not extend into the chamber interior of the combustion chamber, the heating portion comprising at least two tiers, each tier comprising a spiral coil comprising a plurality of spirals, the spirals of each tier lying substantially in a common plane, the plane of each tier being substantially horizontally oriented, each tier of the heating portion having an outermost spiral and an innermost spiral with spirals nested therebetween, the outermost spiral of the spiral coil of the heating portion being connected to the uppermost loop of the helical coil of the preheating portion, the outermost loop of the heating portion having a diameter approximately equal to the loops of the preheating portion;

wherein the heating portion of the heating conduit includes an upper tier oriented above a lower tier, the innermost spiral of the lower tier being connected to the innermost spiral of the upper tier, the upper and lower tiers being oriented substantially parallel to each other, wherein the tiers are adapted such that fluid is moved from the outermost spiral of the lower tier to the innermost spiral of the lower tier to the innermost spiral of the upper tier to the outermost spiral of the upper tier;

wherein the opening defined by the upper end of the chamber perimeter wall lies in a plane, the spiral coil of the lower tier being located closely adjacent to the plane of the opening such that heat moving out of the chamber interior is forced to move through the spiral coil; and wherein outermost spiral of the lower tier of the heating portion has a diameter that is substantially equal to a diameter of the opening of the upper end of the chamber perimeter wall.

* * * * *

UNITED STATES PATENT AND TRADEMARK OFFICE

CERTIFICATE OF CORRECTION

PATENT NO. : 6,435,174 B1
DATED : August 20, 2002
INVENTOR(S) : Spilde et al.

It is certified that error appears in the above-identified patent and that said Letters Patent is hereby corrected as shown below:

Title page,
Item [73], Assignee, "Siout Steam Cleaner Corporation" should read as follows:
-- Sioux Steam Cleaner Corporation --

Signed and Sealed this

Seventh Day of January, 2003

JAMES E. ROGAN
*Director of the United States Patent and Trademark Office*